US005446472A

United States Patent [19]

Rodeffer

[11] Patent Number: 5,446,472

[45] Date of Patent: Aug. 29, 1995

[54] SYSTEM FOR RAISING AND LOWERING AN ANTENNA

[75] Inventor: Charles E. Rodeffer, Burlington, Iowa

[73] Assignee: Winegard Company, Burlington, Iowa

[21] Appl. No.: 160,039

[22] Filed: Nov. 30, 1993

[51] Int. Cl.[6] ..... H01Q 1/08; H01Q 3/02

[52] U.S. Cl. ..... 343/880; 343/882; 343/714

[58] Field of Search ..... 343/880, 883, 889, 882, 343/901, 903, 900, 713, 714; 248/131, 186, 174; H01Q 1/08, 3/02

[56] References Cited

U.S. PATENT DOCUMENTS 3,665,477 5/1972 Budrow et al. ..... 343/714
4,491,846 1/1985 Buse et al. ..... 343/882
4,663,633 5/1987 Wilson ..... 343/880
4,677,444 6/1987 Perek ..... 343/882
5,003,320 3/1991 Miranda ..... 343/882

*Primary Examiner*—Donald Hajec
*Assistant Examiner*—Hoan Ganh Le
*Attorney, Agent, or Firm*—Dorr, Carson, Sloan & Birney

[57] ABSTRACT

A system is described for raising and lowering an antenna without using an electric motor or hand crank. A shaft is attached to an antenna mounted to the roof of a recreational vehicle. A first adapter engages the shaft. A second adapter couples with the first adapter. A portable self-powered activating device such as an electric screwdriver is secured by a chuck to the second adapter. The rotational force generated by the activating device is transferred via the first and second adapters to the shaft to raise or lower the antenna.

6 Claims, 7 Drawing Sheets

SYSTEM FOR RAISING AND LOWERING AN ANTENNA

BACKGROUND OF THE INVENTION

1. Field of the Invention

The present invention relates generally to the field of antennas. More specifically, the present invention discloses a system for raising and lowering an antenna mounted to the roof of a recreational vehicle by using a self-powered rotary tool.

2. Statement of the Problem

The use of recreational vehicles (RVs) has become popular. These vehicles often are equipped with a television antenna so that high-quality television signals can be received wherever the RV is parked. Approximately 750 thousand to 1 million such antennas have been manufactured. The antenna is lowered while the RV is in motion to avoid the effects of wind on the antenna. Thus, the antenna must be raised to be used.

A small electric motor has been conventionally used to raise and lower the antenna, but the cost of such motors is substantial. The antenna can also be conventionally raised and lowered with a hand crank. Many RV owners are elderly, however, and find it difficult to turn a hand crank. A need exists to easily raise and lower such antennas without using an expensive electric motor or a hand crank.

Solution to the Problem

The present invention provides a system to raise and lower a television antenna mounted to the roof of an RV by using a self-powered rotary tool such as a conventional electric screwdriver. Adapters are utilized to transfer the rotational force from the rotary tool to a shaft that raises and lowers the antenna. A hand crank can be integrated into the system.

SUMMARY OF THE INVENTION

This invention provides a system for raising and lowering an antenna without using an electric motor or hand crank. The system comprises a shaft attached to the antenna and two adapters that transfer the rotational force from a self-powered rotary tool such as an electric screwdriver to an operative shaft of the antenna in order to position the antenna in at least two separate levels.

A first adapter comprises opposing first and second ends. The first end of the first adapter has a formed socket that fixedly engages the shaft. A second adapter also comprises opposing first and second ends. The first end of the second adapter couples to the second end of the first adapter. The self-powered rotary tool comprises a chuck that secures to the second end of the second adapter. The two adapters cooperate together so as to transfer rotational power from the tool to the shaft despite engagement at different angles. The rotational force generated by the rotary tool is transferred via the two adapters to the shaft, thus raising and lowering the antenna without using an expensive electric motor or hand crank.

These and other advantages, features, and objects of the present invention will be more readily understood in view of the following detailed description and the drawings.

DETAILED DESCRIPTION OF THE INVENTION

A. General Overview

Figure 1:
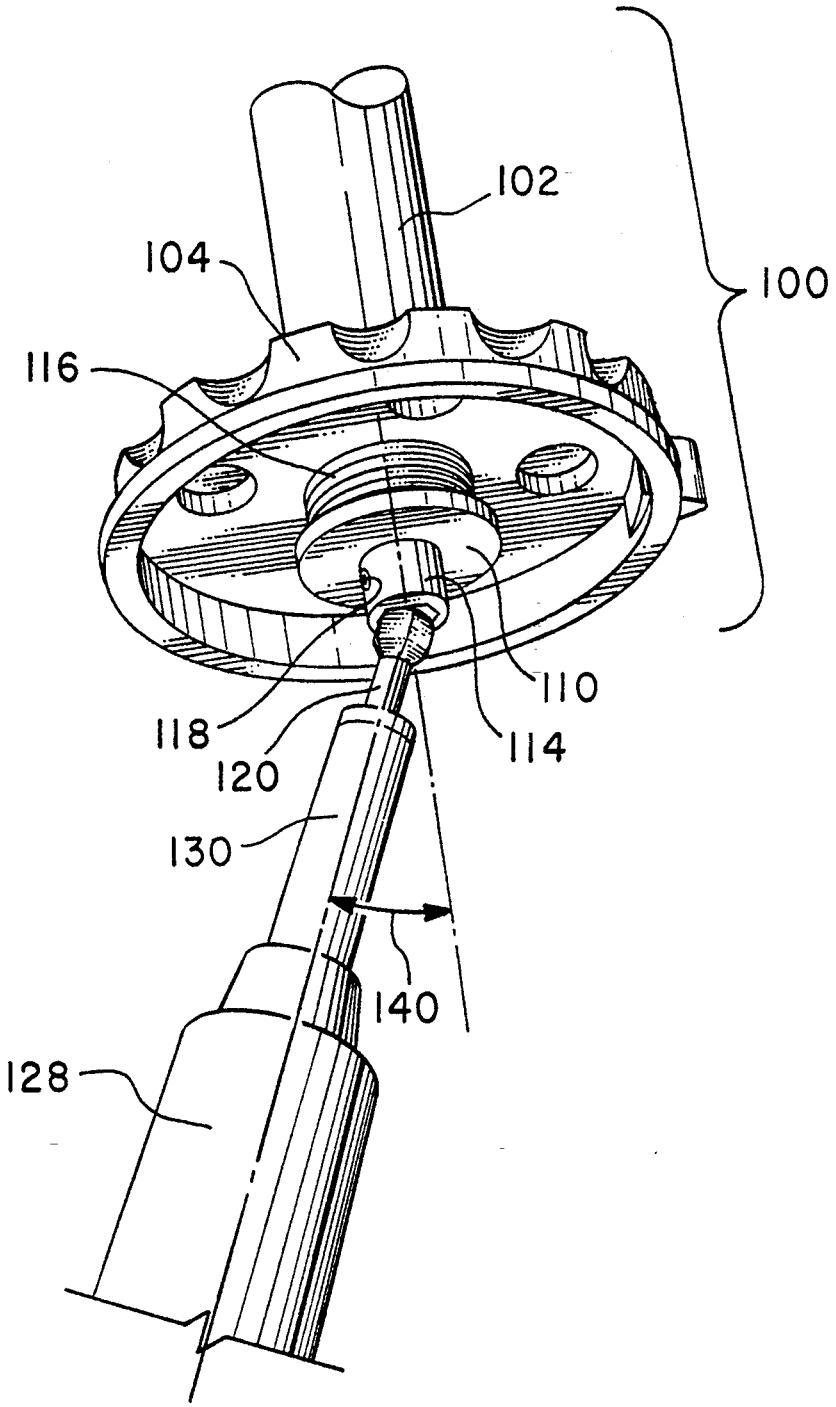
FIG. 1 is a perspective view of the system that raises and lowers an antenna.
Figure 2:
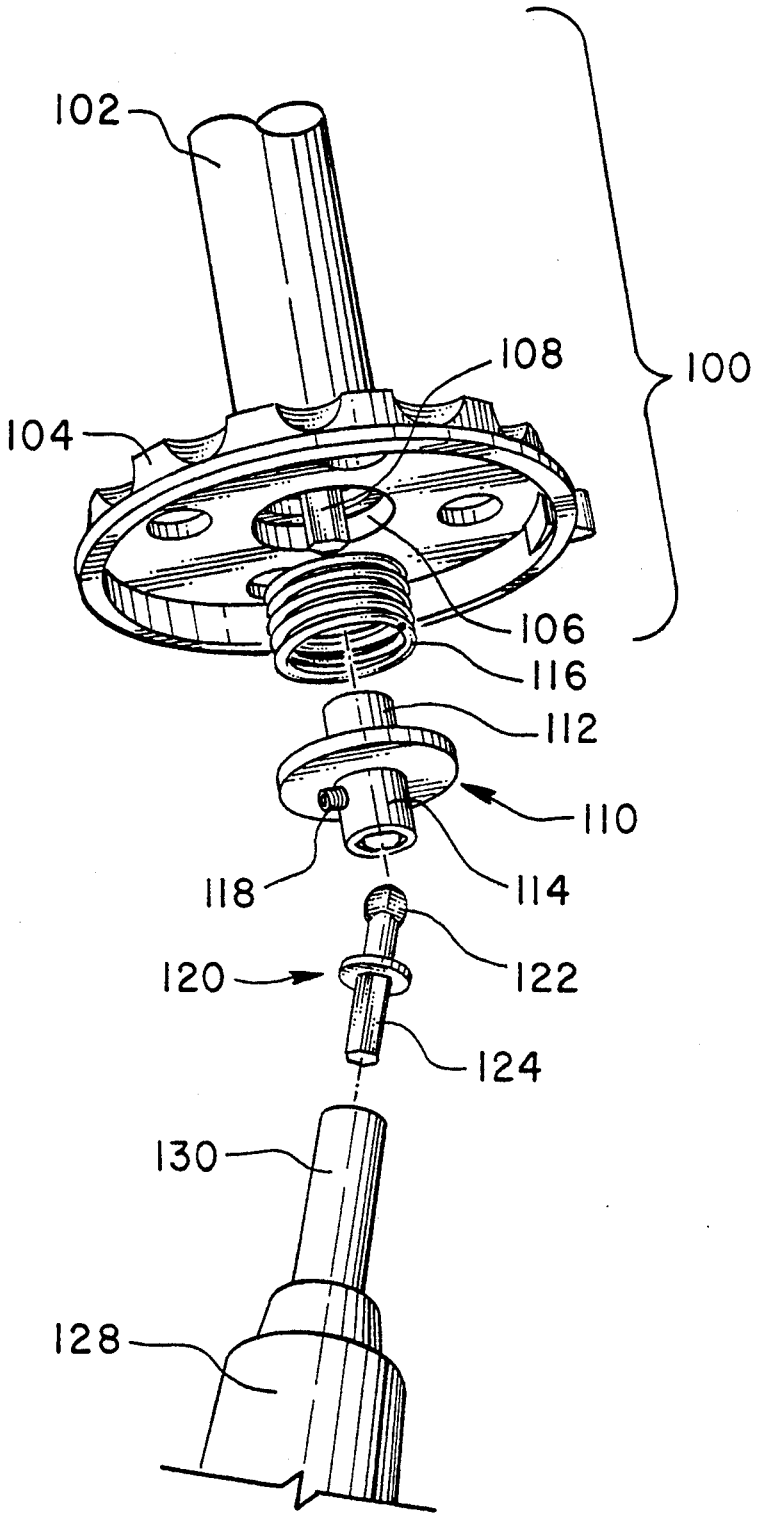
FIG. 2 is an exploded perspective view of the system shown in FIG. 1.

Turning to FIGS. 1 and 2, a shaft housing 100 comprises a tube 102 with a flange 104 at its proximal end 103. Tube 102 contains a hexagonal shaft 108 attached to an antenna 1301 for positioning the antenna 1301 such as raising and lowering the antenna 1301.

A first adapter 110 having a first end 112 and a second end 114 fixedly engages the shaft 108 at the first end 112. First adapter 110 is separated from flange 104 by a spring 116. Shaft 108 is secured in the first end 112 of the first adapter 110 by a setscrew 118 and remains in place.

A second adapter 120 has a first end 122 and a second end 124. The first end 122 of second adapter 120 couples with the second end 114 of first adapter 110 at any of a plurality of angles 140.

A portable self-powered activating device 128 such as a power drill is selectively secured to the second end 124 of second adapter 120 by a chuck 130 in a conventional fashion. The rotational force generated by activating device 128 is transferred via the first and second adapters 110, 120 to rotate the shaft 108 about its axis to raise or lower the antenna 1301 despite the angle 140 of engagement.

B. First Adapter 110

Figure 3:
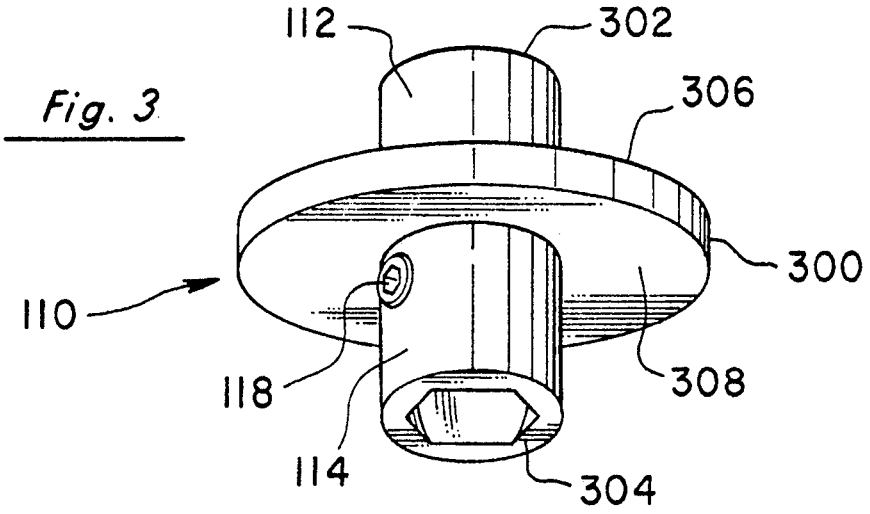
FIG. 3 shows a perspective view of the first adapter.

In the preferred embodiment, the first adapter 110 as shown in FIG. 3 is cylindrical in shape, having a first end 112 and a second end 114 opposing first end 112. First end 112 and second end 114 are separated by a flange 300 as shown in FIG. 3. Flange 300 acts as a stop for spring 116, which is located between flange 104 and flange 300.

Figure 4:
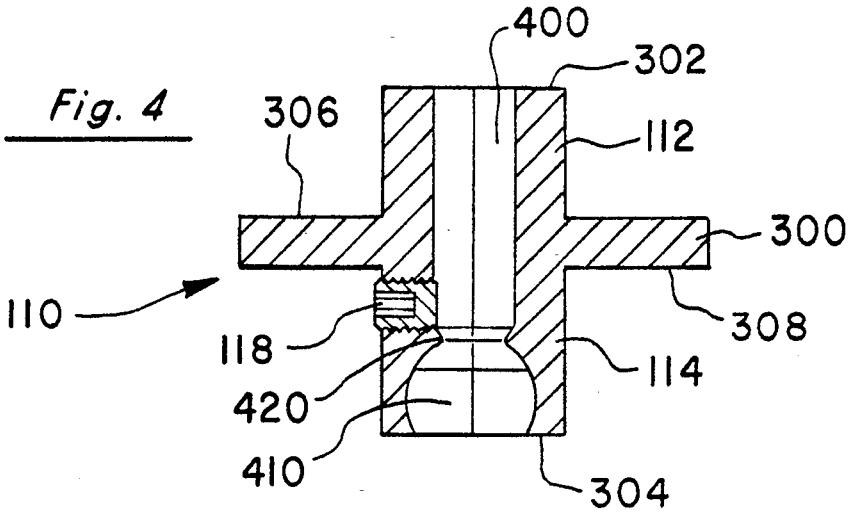
FIG. 4 shows a side cross-sectional view of the first adapter.
Figure 5:
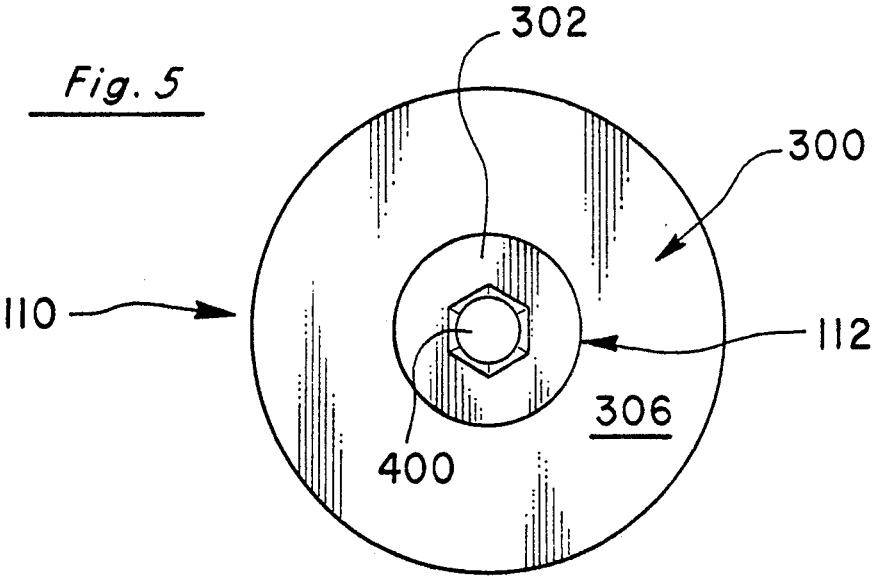
FIG. 5 is a top plan view of the first adapter.

First end 112 is cylindrical in shape terminating in an upper flat region 302 that has a first hexagonal socket 400 formed therein, as shown in FIGS. 4 and 5. First hexagonal socket 400 extends past flange 300 of first adapter 110. First hexagonal socket 400 engages over shaft 108, which is held in first hexagonal socket 400 by setscrew 118. Setscrew 118 is located below flange 300, distal to first end 112. It is to be understood that socket 400 could be of any configuration that matches the configuration of shaft 108.

Figure 6:
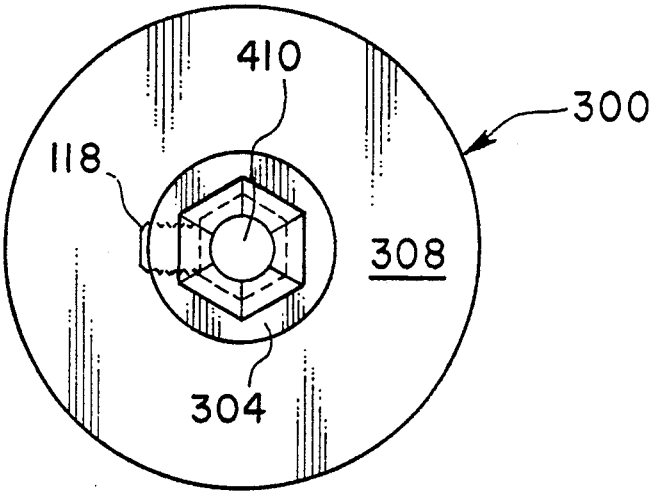
FIG. 6 is a bottom plan view of the first adapter.

Second end 114 is cylindrical in shape terminating in a lower flat region 304 that has a second hexagonal socket 410 formed therein, as shown in FIGS. 4 and 6. Second hexagonal socket 410 is contiguous and aligned with first hexagonal socket 400. A shoulder 420 separates first hexagonal socket 400 from second hexagonal socket 410. Shoulder 420 additionally acts as a stop for shaft 108 when first hexagonal socket 400 engages shaft 108. Shoulder 420 is located immediately below setscrew 118, such that setscrew 118 is positioned between shoulder 420 and flange 300. Second hexagonal socket 410 forms the hex socket of a hex ball-and-socket joint, as described more fully below.

Flange 300 has flat upper and lower surfaces 306 and 308 and is approximately twice the diameter of ends 112 and 114 (which are of substantially the same diameter).

C. Second Adapter 120

Figure 7:
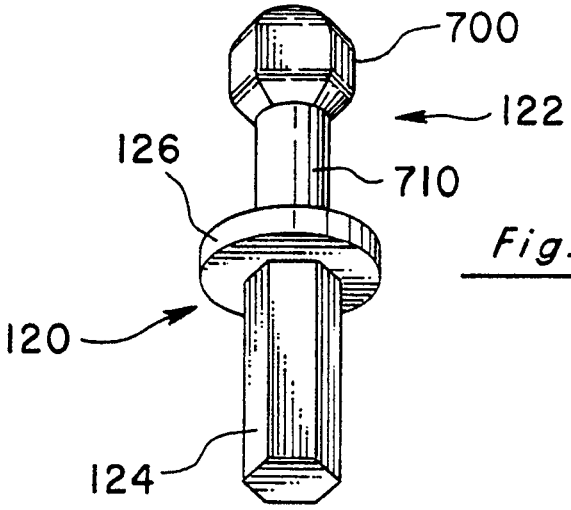
FIG. 7 shows a perspective view of the second adapter.
Figure 8:
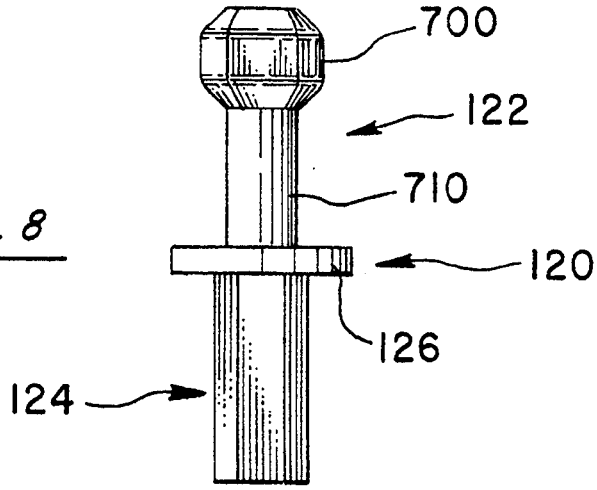
FIG. 8 is a side elevational view of the second adapter.

FIGS. 7 and 8 illustrate a second adapter 120 having a first end 122 and a second end 124. The first end 122 of second adapter 120 terminates in a hex ball 700 mounted onto a pedestal 710. The hex ball 700 couples into the second hexagonal socket 410 of the second end 114 of first adapter 110. The hex ball-and-socket joint formed by the first end 122 of the second adapter 120 and the second hexagonal socket 410 of the first adapter 110 allows the second adapter 120 to be coupled with the first adapter 110 at a variety of angles 140, making it easier for the operator to raise or lower the antenna.

The second end 124 of the second adapter 120 is shaped so as to conventionally fit into a chuck 130 on the portable self-powered activating device 128. FIG. 7 shows the second end 124 of the second adapter 120 as being hexagonal; however, the second end 124 could have any shape that would allow a chuck to be secured to the second end 124.

A flange 126 separates the first end 122 from the second end 124 of the second adapter 120. Flange 126 acts as a stop when the second end 124 is fitted into the chuck 130.

D. Portable Self-Powered Activating Device 128

The portable self-powered activating device 128 is a conventional rotary tool such as an electric screwdriver or electric drill. Such conventional tools have bi-directional switches so as to selectively change the direction of the rotation in order to raise or lower the antenna 1301.

E. Alternative Embodiment

Figure 9:
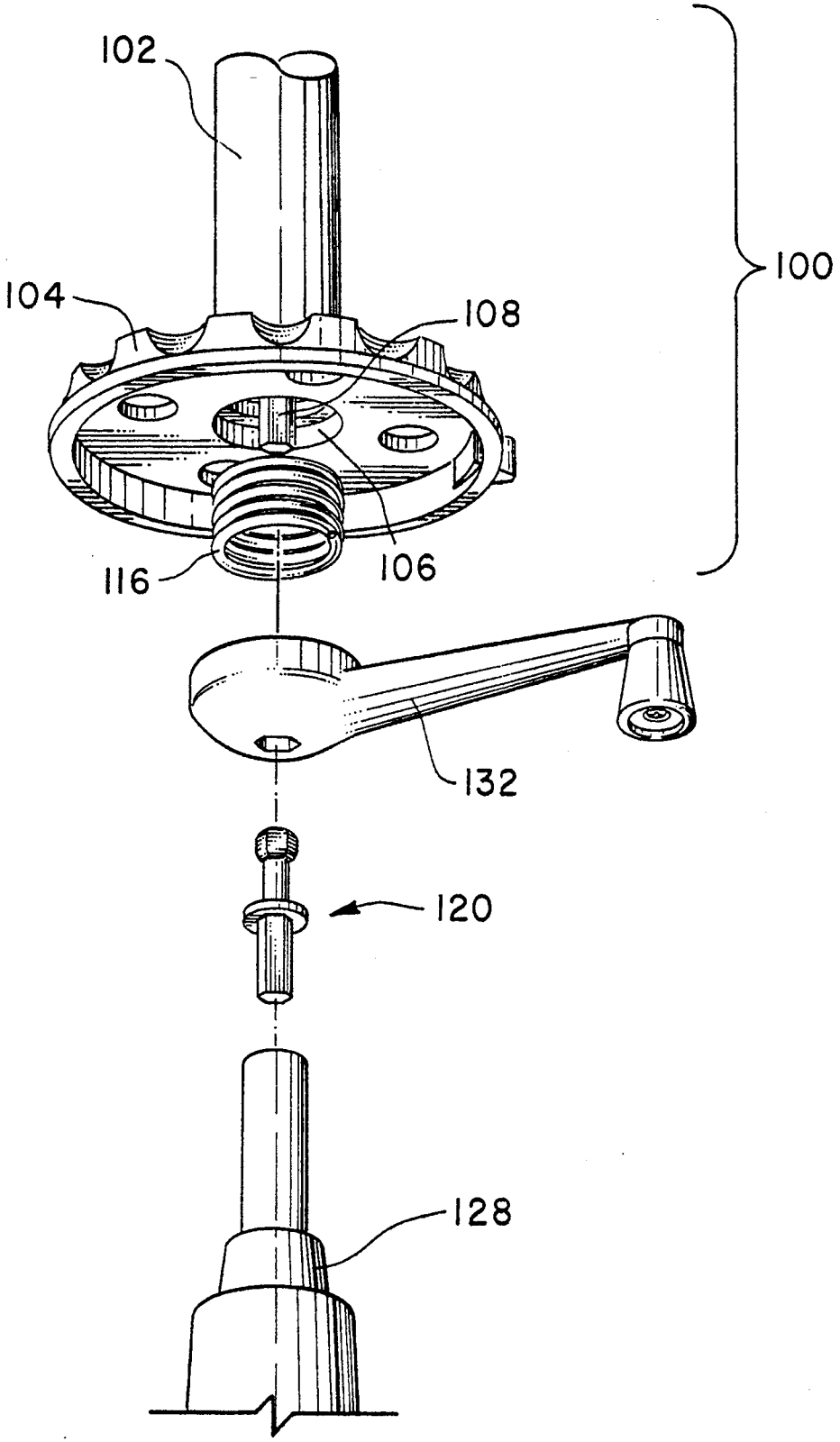
FIG. 9 shows an exploded perspective view of the system shown in FIG. 1 when the first adapter is a hand crank.

In an alternative embodiment, shown in FIG. 9, the first adapter is a conventional hand crank 132 modified to incorporate the first adapter 110.

Figure 10:
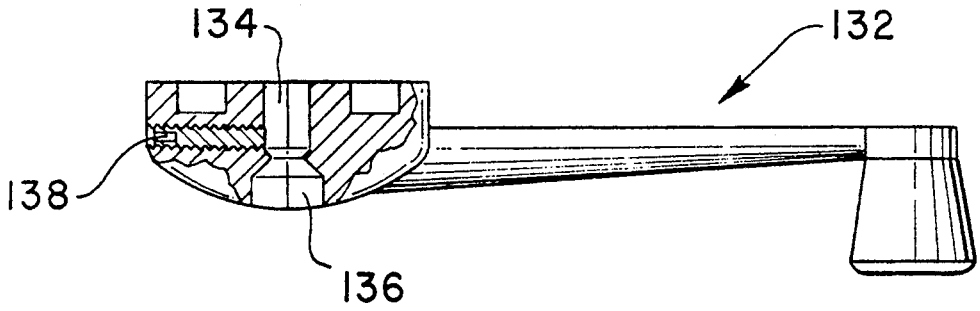
FIG. 10 is a side elevational view of the hand crank with a partial cross-section.
Figure 12:
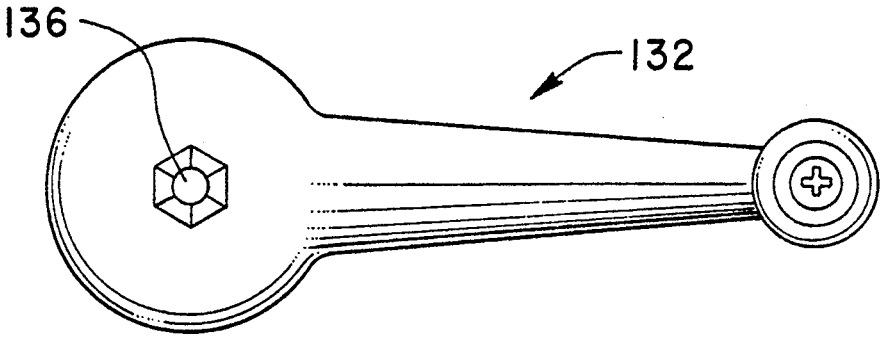
FIG. 12 is a bottom plan view of the hand crank.
Figure 11:
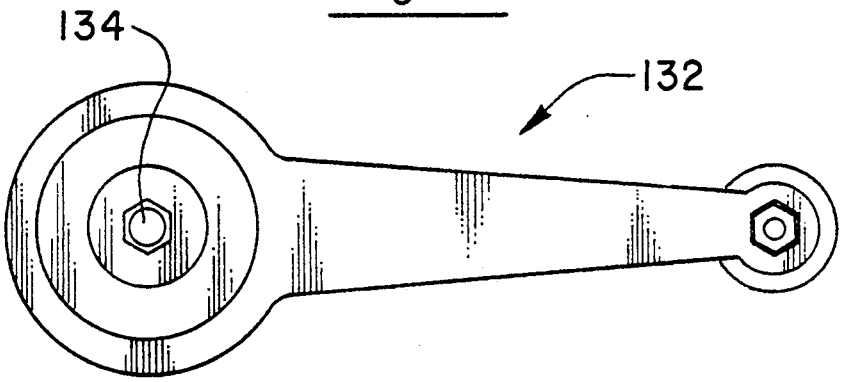
FIG. 11 is a top plan view of the hand crank.

A side elevational view of the hand crank 132 with a partial cross-section is shown in FIG. 10. The hand crank 132 has opposing first 134 and second 136 hexagonal sockets, as illustrated in FIGS. 11 and 12, respectively. The first hexagonal socket 134 engages the shaft 108, which is held therein by a setscrew 138. The second hexagonal socket 136 couples with the hex ball at the first end 122 of the second adapter 120. This embodiment enables the operator to raise and lower the antenna by using either the hand crank 132 or the rotary device 128.

Figure 13:
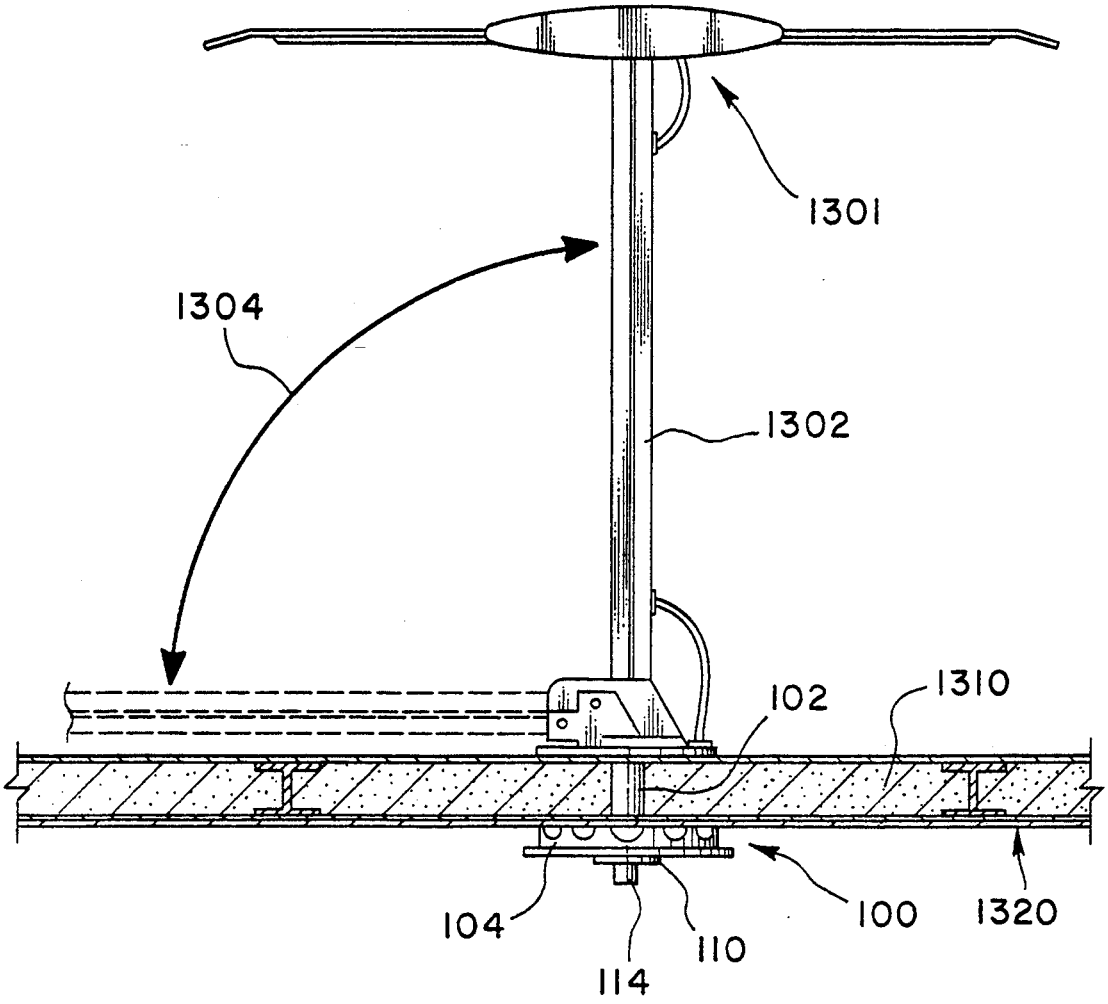
FIG. 13 is a side elevational view of the antenna showing both the raised and lowered positions.

FIG. 13 shows the relationship of the present invention with the prior art antenna and antenna mounting on the roof of an RV. The antenna 1301 is mounted on the roof 1310 of an RV, with tube 102 extending through the roof. Flange 104 abuts the ceiling 1320 of the interior of the RV. When adapter 110 is rotated, the pole 1302 on which antenna 1301 is mounted is raised or lowered as shown by arrows 1304. It is to be understood that any configuration for antenna 1301 could be used.

The above disclosure sets forth a number of embodiments of the present invention. Other arrangements or embodiments, not precisely set forth, could be practiced under the teachings of the present invention and as set forth in the following claims.

I claim:

1. A system for raising and lowering an antenna, said system comprising:

(a) means attached to said antenna for positioning said antenna in at least two separate levels, said positioning means having a shaft;

(b) means selectively engaging said shaft for rotating said shaft, said rotating means comprising:

(i) a first adapter, said first adapter engaging said shaft, said first adapter being a crank.

(ii) a second adapter, said second adapter coupling with said first adapter at a plurality of angles; and (c) a portable self-powered activating device, said device securing to said second adapter to provide rotational force through said first and second adapters to rotate said shalt to position said antenna in one of said separate levels.

2. A system for raising and lowering an antenna, said system comprising:

(a) means attached to said antenna for positioning said antenna in at least two separate levels, said positioning means having a shaft, said shaft having a projecting end;

(b) means selectively engaging said shaft for rotating said shaft about its axis, said rotating means comprising:

(i) a first adapter having a first end, said first end having a formed first socket, said formed first socket engaging said projecting end of said shaft, said first adapter also having a second end opposed to said first end, said second end having a formed second socket; and (ii) a second adapter having a first end and a second end, said first end coupling with said formed second socket of said second end of said first adapter; and (c) a portable self-powered activating device, said device having a chuck, said chuck securing to said second end of said second adapter to provide rotational force through said first and second adapters so as to rotate said shaft about its axis to one of said separate levels.

3. The system of claim 2 wherein said portable self-powered activating device is a rotary tool.

4. The system of claim 2 wherein said first adapter is a hand crank.

5. A system for raising and lowering an antenna, said system comprising:

(a) means attached to said antenna for positioning said antenna in at least two separate levels, said positioning means having a shaft, said shaft having a projecting end, said shaft being hexagonal in shape;

(b) means selectively engaging said shaft for rotating said shaft, said rotating means comprising:

(i) a first adapter having a cylindrical shape, said first adapter having a first end, said first end having a hexagonal socket, said hexagonal socket engaging said projecting end of said hexagonal shaft; said first adapter having a second end opposed to said first end, said second end having a hex ball socket therein, said hex ball socket separated from said hexagonal socket of said first end by a shoulder; said first adapter having a flange between said first end and said second end; said first adapter having a setscrew, said setscrew engaging said shaft between said shoulder and said flange;

(ii) a second adapter having a first end, said first end comprising a hex ball, said hex ball releasably coupling at a plurality of angles with said hex socket of said second end of said first adapter; said second adapter having a second end opposed to said first end, said second end being hexagonal in shape; said second adapter having a flange between said first end and said second end; and (c) a portable self-powered activating device, said device having a chuck, said chuck securing to said hexagonal second end of said second adapter up to said flange to provide rotational force through said first and second adapters so as to rotate said shaft to position said antenna at one of said separate levels.

6. The system of claim 5 wherein said first adapter is a hand crank.

* * * * *